US006390581B1

(12) United States Patent
Lee et al.

(10) Patent No.: US 6,390,581 B1
(45) Date of Patent: May 21, 2002

(54) INK JET PRINTER HEAD

(75) Inventors: Chang-Woo Lee; Chang-Youl Moon, both of Suwon; Oh-Hyun Beak, Seoul; Jae-Ho Moon, Suwon, all of (KR)

(73) Assignee: SamSung Electronics, Co., Ltd., Suwon (KR)

( * ) Notice: Subject to any disclaimer, the term of this patent is extended or adjusted under 35 U.S.C. 154(b) by 0 days.

(21) Appl. No.: 09/643,836

(22) Filed: Aug. 21, 2000

(30) Foreign Application Priority Data

Sep. 27, 1999 (KR) ..... 99-41339

(51) Int. Cl.[7] ..... B41J 29/38
(52) U.S. Cl. ..... 347/12; 347/9
(58) Field of Search ..... 347/9–11, 15

(56) References Cited

U.S. PATENT DOCUMENTS

| | | | | | |
|---|---|---|---|---|---|
| 4,409,596 | A | | 10/1983 | Ishii | 347/11 |
| 4,471,363 | A | | 9/1984 | Hanaoka | 347/10 |
| 4,714,935 | A | | 12/1987 | Yamamoto et al. | 347/10 |
| 5,028,812 | A | | 7/1991 | Bartky | 307/246 |
| 5,103,246 | A | * | 4/1992 | Dunn | 347/58 |
| 5,541,629 | A | * | 7/1996 | Saunders et al. | 347/12 |
| 5,541,630 | A | | 7/1996 | Ema et al. | 347/70 |
| 5,644,342 | A | * | 7/1997 | Argyres | 347/12 |
| 5,821,953 | A | | 10/1998 | Nakano et al. | 347/10 |
| 5,936,644 | A | | 8/1999 | Ono et al. | 347/10 |
| 5,988,784 | A | * | 11/1999 | Takemura et al. | 347/8 |
| 6,017,112 | A | * | 1/2000 | Anderson et al. | 347/40 |
| 6,053,596 | A | | 4/2000 | Nakano et al. | 347/15 |
| 6,081,280 | A | * | 6/2000 | Bolash et al. | 347/9 |

OTHER PUBLICATIONS

National Semiconductor, Logic Databook, 1981, National Semiconductor Corp., 6–174–6–177.*

* cited by examiner

*Primary Examiner*—John Barlow
*Assistant Examiner*—Alfred E Dudding
(74) *Attorney, Agent, or Firm*—Robert E. Bushnell, Esq.

(57) ABSTRACT

An ink jet printer head having nozzles, actuators, a multiplexer, and actuator finding circuits of a matrix method. The multiplexer is capable of single-input and multiple output. The actuator finding circuits of the inkjet printer head include electronic switches arranged in rows and columns. The nozzles have the actuators, and the actuators are controlled by the electronic switches. The multiplexer receives a signal in accordance with the conveyance direction and position of the ink jet printer head, and sequentially outputs the signal to the actuator finding circuits in accordance with the signal it received, thereby sequentially selecting a nozzle group in the rows. In this situation, when an external print data signal is inputted to the actuator finding circuits to select a nozzle group in the columns, the corresponding electronic switch drives the actuator, so that the ink is ejected out of the nozzle. Accordingly, by using the multiplexer having only one external input terminal, the increment of the number of pads is decreased when the number of ink jet printer head nozzles is increased.

20 Claims, 5 Drawing Sheets

INK JET PRINTER HEAD

CLAIM OF PRIORITY

This application makes reference to, incorporates the same herein, and claims all benefits accruing under 35 U.S.C. §119 from an application entitled Ink Jet Printer Head earlier filed in the Korean Industrial Property Office on Sep. 27, 1999, and there duly assigned Serial No. 99-41339 by that Office.

BACKGROUND OF THE INVENTION

1. Field of the Invention

The present invention relates to an ink jet printer, and more particularly to an ink jet printer head capable of reducing a number of pads which are increased in accordance with the increment of nozzles, by using a device having a single input and multiple outputs.

2. Description of the Background Art

Generally, an ink jet printer head includes a plurality of actuators, nozzles corresponding to the respective actuators, and actuator finding circuits for selecting the nozzle and for ejecting ink through the selected nozzle. Generally also, a plurality of nozzles are divided into a plurality of groups, while the actuator finding circuits are divided into a direct drive method and a drive method of matrix structure (hereinafter referred to as "matrix drive method"), respectively.

As for the matrix drive method, since the nozzles are arranged in rows and columns, the lines are not increased in proportion to the number of nozzles when the nozzles are increased. However, the problem still arises in that the number of pads is increased in proportion to the increased rows and columns.

As for the inkjet printer, since the increase of the number of heads employed to enhance both printing quality and speed results in the increase of the number of pads which connect the signal lines of the heads, the manufacturing cost of the printer heads is increased, while the yield of the printer heads is decreased.

An exemplar of the art, U.S. Pat. No. 5,028,812 for Multiplexer Circuit issued to Bartky discloses a multiplexer circuit used in an inkjet printer. U.S. Pat. No. 4,714,935 for Ink-jet Head Driving Circuit issued to Yamamoto et al., U.S. Pat. No. 5,936,644 for Head Driving Device of Ink-jet Printer issued to Ono et al., U.S. Pat. No. 5,541,630 for Injet Print Head and Inkjet Printer issued to Ema et al., U.S. Pat. No. 4,409,596 for Method and Apparatus for Driving an Ink Jet Printer Head issued to Ishii, U.S. Pat. No. 4,471,363 for Method and Apparatus for Driving an Ink Jet Printer Head issued to Hanaoka, U.S. Pat. No. 6,053,596 for Ink-jet Printing Device and Driving Circuit Used in the Ink-jet Printing Device issued to Nakano et al., and U.S. Pat. No. 5,821,953 for Ink-jet Head Driving System issued to Nakano et al. disclose ink jet printer heads and techniques for driving an ink jet printer head.

SUMMARY OF THE INVENTION

The present invention has been made to overcome the above-described problems of the prior art, and accordingly, it is an object of the present invention to provide an ink jet print head capable of reducing the number of pads which are increased due to the increased nozzles, by using a device having a single input and multiple outputs.

It is another object to have an ink jet printer head driver circuit that can be contained in a single semiconductor microchip.

It is yet another object to have an inkjet printer head that reduces the number of lines feeding the nozzles.

It is another object to reduce the cost of manufacture of the ink jet printer by reducing the complexity of the driving circuit for the ink jet printer head.

The above objects are accomplished by an ink jet printer head including a first unit having a first input terminal and a plurality of output terminals, an externally applied first signal transmitting into the first input terminal, the first unit outputting a second signal from the applied first signal, the second signal being outputted through a first one of the plurality of output terminals sequentially by order of the first signal inputted through the first input terminal, a first signal line conducting the second signal from the first output terminal of the first unit, a second input terminal having an externally applied third signal, a second signal line conducting the third signal from the second input terminal, an electronic switch accepting the second signal from the first unit through the first signal line and the third signal from the second input terminal through the second signal line, an actuator electrically controlled by the electronic switch, and a nozzle ejecting ink through a control of the actuator, the nozzle ejecting ink when the third signal and the second signal is received by the electronic switch.

The first signal is generated in accordance with a conveyance direction and position of the head, while the second signal is generated in accordance with image data. The first unit includes a multiplexer, while the ink jet printer head is made of a semiconductor chip.

By the above-described structure, even when the number of nozzles in the ink jet printer heads is increased, since the number of inputting lines for the multiplexer still remains one, the number of pads does not increase as much.

Additional objects and advantages of the invention will be set forth in part in the description which follows and, in part, will be obvious from the description, or may be learned by the practice of the invention.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
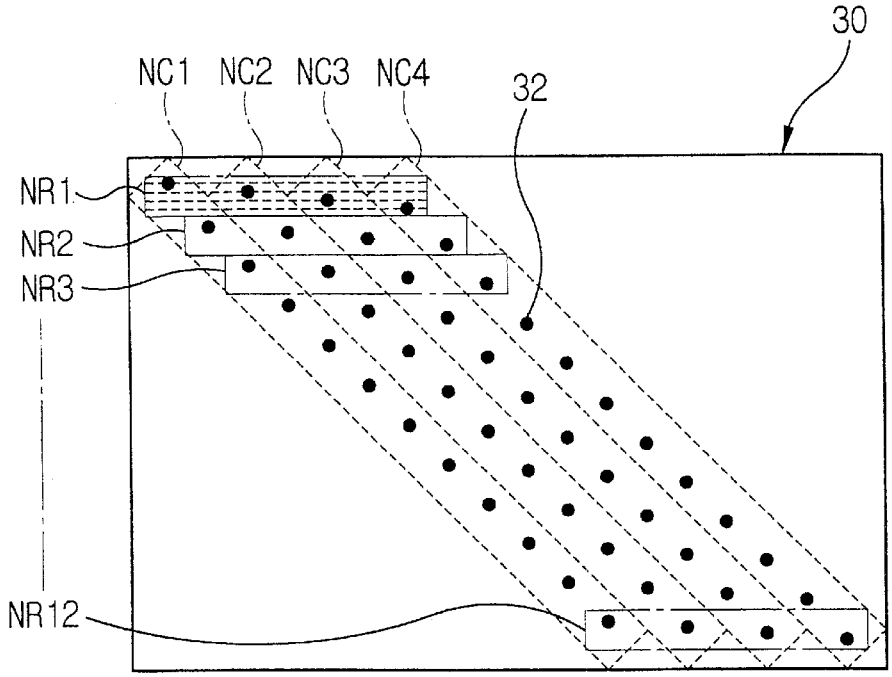
FIG. 1 is a schematic view of nozzles in an ink jet printer head.
Figure 2:
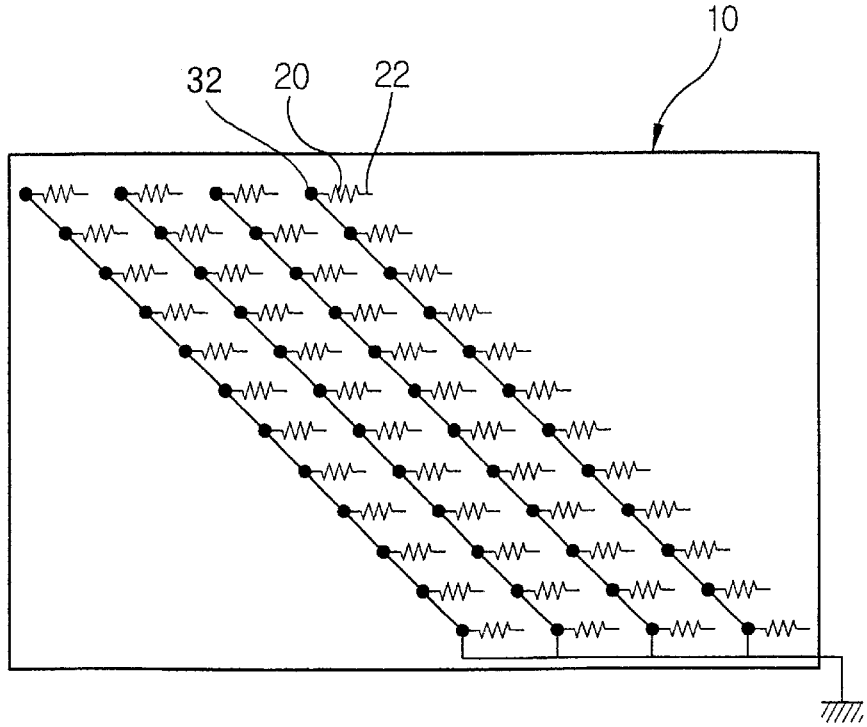
FIG. 2 is a schematic view of a direct drive method for driving the nozzles in an ink jet printer head of FIG. 1.

Turning now to the drawings, referring to FIG. 1, an ink jet printer head 30 has multiple nozzles 32 shown in the form of black dots, with each black dot representing one nozzle 32. Referring to FIG. 2, the reference numeral 22 collectively refers to lines, and 20 collectively refers to actuators. Here, for easier reference, the reference numeral 22 representatively designates one actuator. As already mentioned above, the direct drive method 10 includes a plurality of actuators 20, which are formed on the respective nozzles 32. The actuators 20 may be formed of heating elements. The lines 22 electrically connect the inkjet printer head 30 to a printer, and directly supply the driving voltage to the respective actuators 20. Accordingly, the ink jetting of the nozzles is directly carried out through the lines 22 which are connected to the respective nozzles 32. In an initially developed ink jet printer, the number of nozzles was far fewer than the nozzles in the recently developed ink jet printer. Accordingly, as shown in FIGS. 1 and 2, the direct drive method was usefully employed in which the nozzles and the pads correspond to each other one to one.

As shown in FIG. 1, the plurality of nozzles 32 constitute a plurality of nozzle groups, i.e., the four groups of nozzles NC1, NC2, NC3, and NC4 in four columns, and twelve groups of nozzles NR1, NR2, NR3, . . . and NRI2 in twelve rows.

Figure 3:
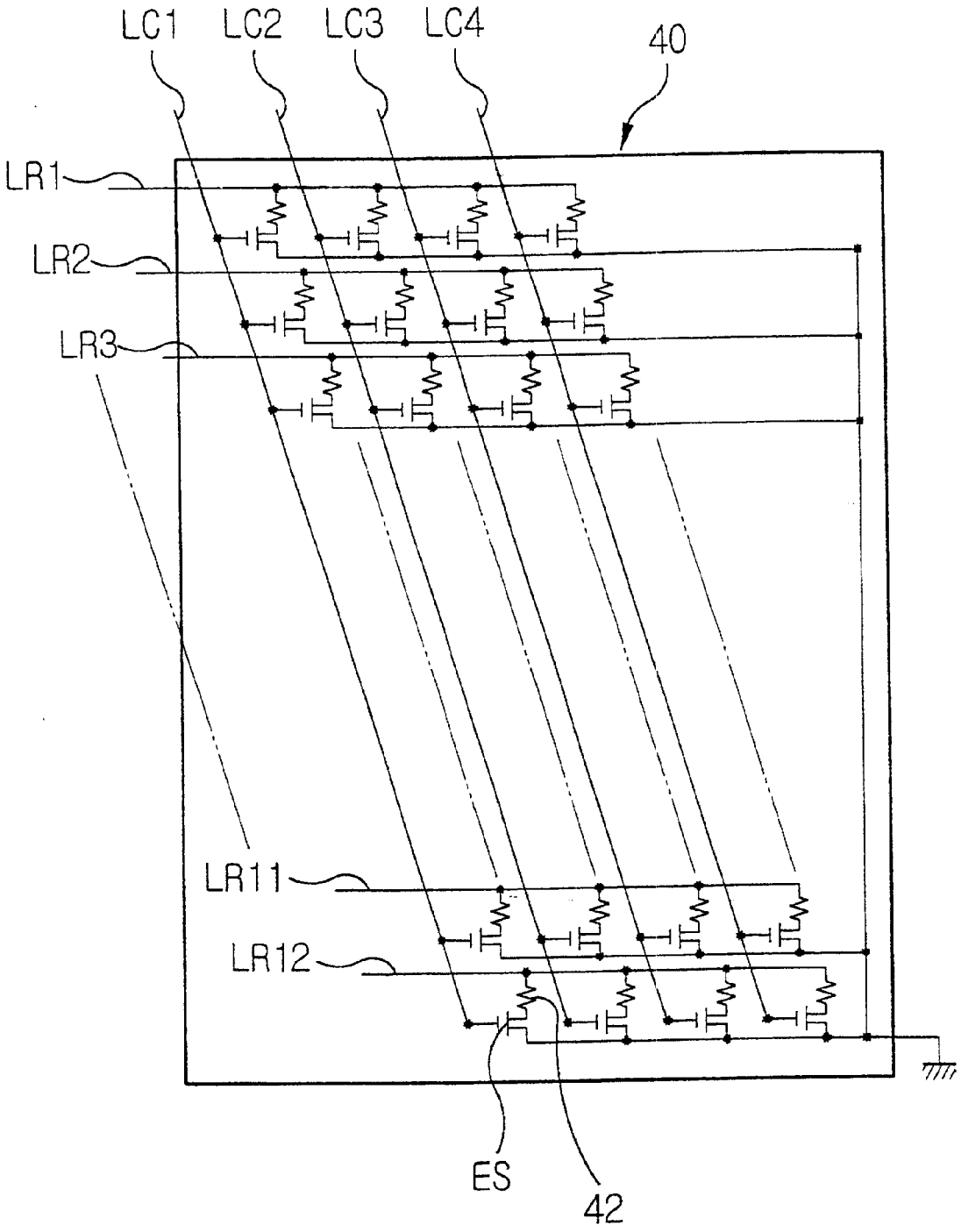
FIG. 3 is a schematic view of a matrix drive method for driving the nozzles in the ink jet printer head of FIG. 1.

Referring to FIG. 3, the matrix drive method 40 is shown for driving the nozzles of the ink jet printer head 30. The reference numeral 42 collectively refers to the actuators, and reference and symbol ES collectively refers to electronic switches. Here, for easier reference, the reference numeral and symbol 42 and ES representatively designate one actuator and one electronic switch, respectively. Further, the reference symbols LC1, LC2, LC3, and LC4 refer to lines in four columns, while LR1, LR2, LR3, . . . , and LR12 refer to lines in twelve rows.

Since a plurality of actuators 42 are formed at the plurality of nozzles 32 to drive the nozzles 32, the actuators 42 are also arranged in rows and columns along the nozzle groups in rows NR1, NR2, NR3, . . . , and NR12, and in columns NC1, NC2, NC3, and NC4, respectively. Further, the plurality of electronic switches ES are also arranged in rows and columns along the actuators 42, to drive the plurality of actuators 42. As shown in FIG. 3, the ends of the actuators 42 are connected to the lines in rows LR1, LR2, LR3, . . . , and LR12, respectively, while the other ends of the actuators 42 are connected to the ends of a plurality of electronic switches ES, respectively. The other ends of the electronic switches ES are connected to the lines in columns LC1, LC2, LC3, and LC4.

The actuator 42 may be a heating element, and the electronic switches ES may be transistors, or field effect transistors (FETs).

The matrix drive method shown in FIG. 3 employs the field effect transistors as the electronic switches ES. As shown in FIG. 3, gate terminals of the field effect transistors are connected to the lines in columns LC1, LC2, LC3, and LC4, respectively, drain terminals are connected to the other ends of the actuators 42, respectively, and source terminals are grounded. The operation of the matrix drive method constructed as above will be described briefly below.

Figure 4:
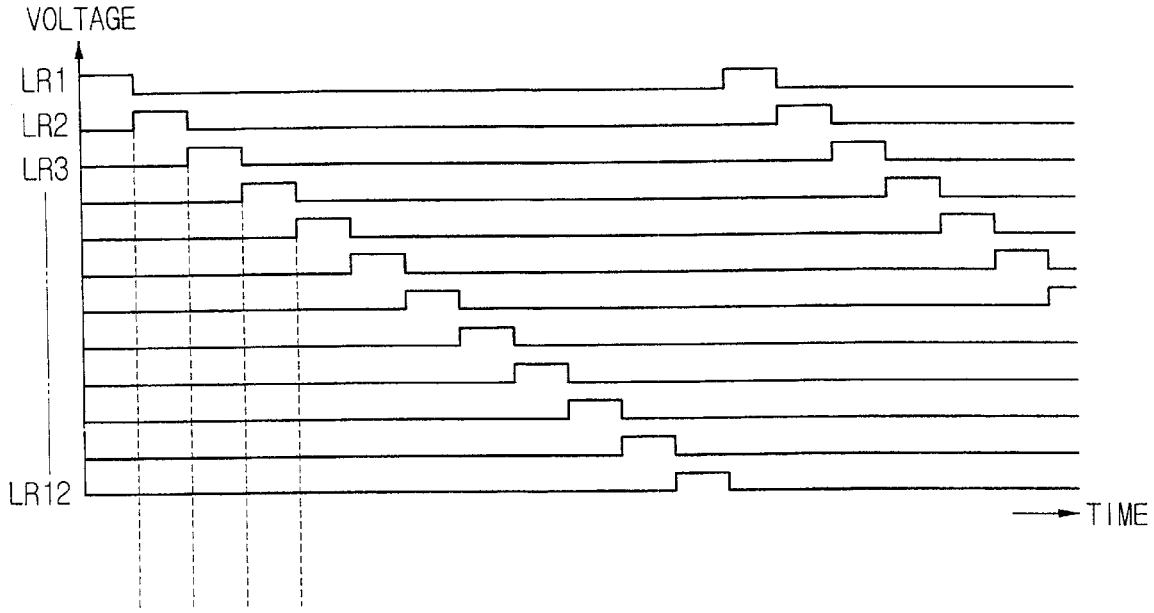
FIG. 4 is a wave form chart of group selecting signals for selecting nozzle groups in rows of the matrix drive method of FIG. 3.
Figure 5:
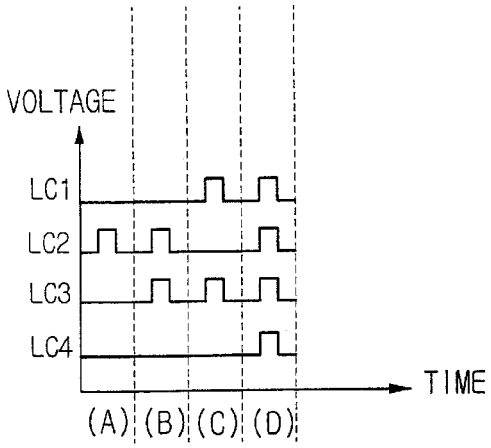
FIG. 5 is a wave form chart of print data signals for selecting nozzle groups in columns of the matrix drive method of FIG. 4.

FIG. 4 is a view for showing the group selecting signal which is for selecting the nozzle group in rows in the matrix drive method of FIG. 3, and FIG. 5 is a view for showing the print data signal to select a nozzle group in the columns in the matrix drive method of FIG. 3.

The group selecting signal is generated from a group selecting signal generator (not shown). Once generated, the group selecting signal applies a pulse voltage to the lines in rows LR1, LR2, LR3, . . . , and LR12 in a sequential manner, by that selecting the nozzle groups in rows at a predetermined time interval. As a result, the lines in rows LR1, LR2, LR3, . . . , and LR12 are not selected simultaneously. The print data signal is generated by a print data signal generator (not shown) in accordance with image data. Once generated, the print data signal is applied to the lines in columns LC1, LC2, LC3, and LC4, which are shown in FIG. 3.

Hereinafter, the preferred embodiment of the present invention will be described in greater detail with reference to the operation of the matrix drive method based on the group selecting signal and the print data signal.

As described above, the direct drive method requires one line 22 for every nozzle 32, and accordingly, the number of lines 22 is increased when the nozzles 32 are increased. Accordingly, the number of pads, which connect the ink jet printer head 30 with the printer, is also increased, so that the manufacturing process becomes more complex, and the unit cost of the inkjet printer head is increased.

Figure 6:
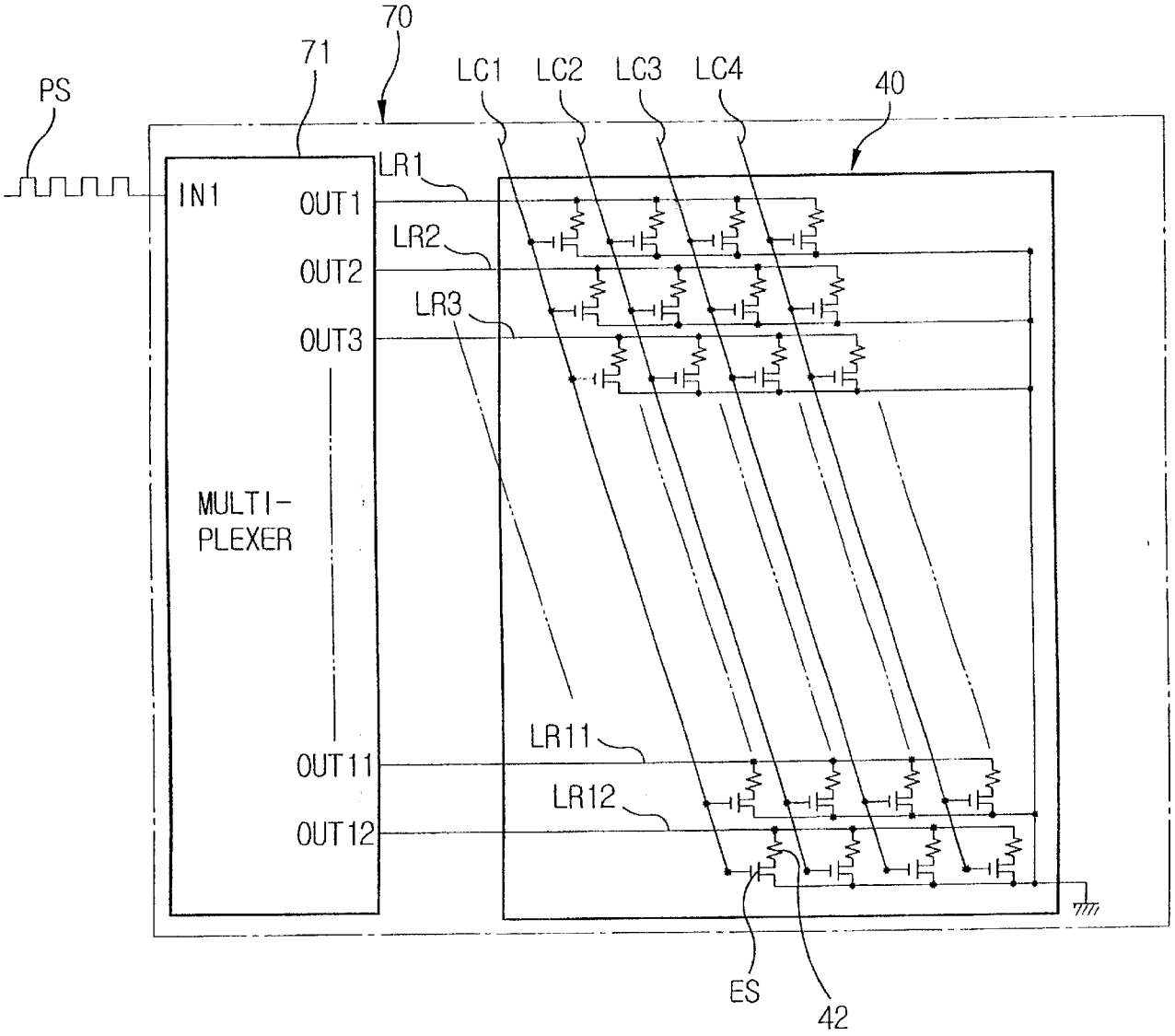
FIG. 6 is a schematic view of a matrix drive method for driving the nozzles of the ink jet printer head according to the preferred embodiment of the present invention.

Referring to FIG. 6, a schematic view is shown of a matrix drive method for driving the nozzles of the ink jet printer head according to the preferred embodiment of the present invention. An ink jet printer head 70 according to the preferred embodiment of the present invention is formed by an incorporation of a multiplexer 71 and the matrix drive method of FIG. 3. The multiplexer 71 includes a first input terminal IN1 and output terminals OUT1, OUT2, OUT3, . . . , OUT11, and OUT12. The output terminals OUT1, OUT2, OUT3, . . . , OUT11, and OUT12 are connected to the lines in rows LR1, LR2, LR3, . . . , LR11, and LR12 shown in FIG. 6. The construction of the matrix drive method will be briefly described below. The type of multiplexer 71 having a single input such as IN1 and multiple output terminals such as OUT1 to OUT 12, is sometimes also referred to as a demultiplexer.

In the matrix drive method, in order to drive the plurality of nozzles 32, the plurality of actuators 42 are formed at the plurality of nozzles 32, respectively, arranged in rows and columns along the nozzle groups in rows NR1, NR2, NR3, . . . , and NR12, and in columns NC1, NC2, NC3, and NC4. Further, in order to drive the plurality of actuators 42, the plurality of electronic switches ES are arranged in rows and columns along the plurality of actuators 42, respectively. As shown in FIGS. 6 and 3, the ends of the plurality of actuators 42 are connected to the corresponding lines in rows LR1, LR2, LR3, and LR4, respectively. The other ends of the actuators 42 are connected to the ends of the electronic switches ES, respectively. The lines in columns LC1, LC2, LC3, and LC4 are connected to gate terminals of the corresponding electronic switches, respectively. The other ends of the electronic switches ES are grounded. The actuators 42 may be heating elements, and the electronic switches ES may be formed of transistors or field effect transistors (FETs).

The matrix drive method according to the preferred embodiment of the present invention employs the field effect transistor as the electronic switches. As shown in FIG. 6, the gate terminals of the field effect transistors are connected to the lines in columns LC1, LC2, LC3, and LC4, respectively, drain terminals are connected to the other ends of the actuators 42, respectively, and source terminals are grounded.

The operation of the matrix drive method constructed as above will be described in greater detail below. Referring to FIGS. 3 and 5, the group selecting signals are generated from a group select signal generator (not shown). The group selecting signals, as shown in FIG. 4, apply a pulse voltage to the lines in rows LR1, LR2, LR3, . . . , and LR12 shown in FIG. 6 in a sequential manner at predetermined time intervals, so as to select the nozzle groups in rows at predetermined time intervals. Accordingly, the lines in rows LR1, LR2, LR3, . . . , and LR12 cannot be selected simultaneously. Further, the print data signals are generated by a print data signal generator (not shown) in accordance with image data. Once generated, the print data signals are applied to the lines in columns LC1, LC2, LC3, and LC4 shown in FIGS. 4 and 6.

The print data signals apply the pulse voltage to the lines in columns LC1, LC2, LC3, and LC4, either selectively to the lines in one of columns LC1, LC2, LC3, or LC4, or respectively to the lines of all columns LC1, LC2, LC3, and LC4. Time section (A) of FIG. 5 shows the pulse voltage applied to the lines in the second column LC2. Here, as shown in FIG. 4, since the pulse voltage is applied to the lines in the first row LR1, the electronic switch ES in the first row of the second column of FIG. 6 is switched on in the matrix drive method. Accordingly, the voltage is applied to the actuator 42 which is connected to the electronic switch ES which is switched on. Here, if the actuator 42 has a heating element like a heater, the actuator 42 heats the ink within a nozzle chamber (not shown) by the voltage applied to the actuator 42. As the ink is heated, the ink is ejected through the nozzle 32.

Time section (B) of FIG. 5 shows the pulse voltage applied to lines in the second and third columns LC2 and LC3. Here, since the pulse voltage is applied to the lines in second row LR2 of FIG. 4, the electronic switch ES in the second row of the second column, and electronic switch ES in the second row of the third column are switched on, sequentially. Accordingly, the actuator 42 in the second row of the second column, and the actuator 42 in the second row of the third column are sequentially heated, so that the ink is ejected from the two nozzles 32 corresponding to the heated actuators 42, sequentially.

Time section (C) of FIG. 5 shows the pulse voltage being applied to the lines in the first and third columns LC1 and LC3. Here, since the pulse voltage is applied to the lines in the third row LR3 of FIG. 4, the electronic switch ES in the third row of the first column and the electronic switch ES in the third row of the third column are switched on, sequentially. Accordingly, as the actuator 42 in the third row of the first column, and the actuator 42 in the third row of the third column are heated, sequentially, so that the ink is ejected from the two nozzles 32 corresponding to the heated actuators 42, sequentially.

Further, time section (D) of FIG. 5 shows the pulse voltage being applied to the lines in the first, second, third, and fourth columns LC1, LC2, LC3, and LC4. Here, since the pulse voltage is applied to the lines in the fourth row LR4 of FIG. 4, the electronic switches in the fourth row of the first column, fourth row of the second column, fourth row of the third column, and fourth row of the fourth column, are switched on, sequentially. Accordingly, the actuators in the fourth row of the first column, fourth row of the second column, fourth row of the third column, and fourth row of the fourth column are heated, sequentially, so that the ink is ejected from the four nozzles 32 corresponding to the heated actuators 42.

Figure 7:
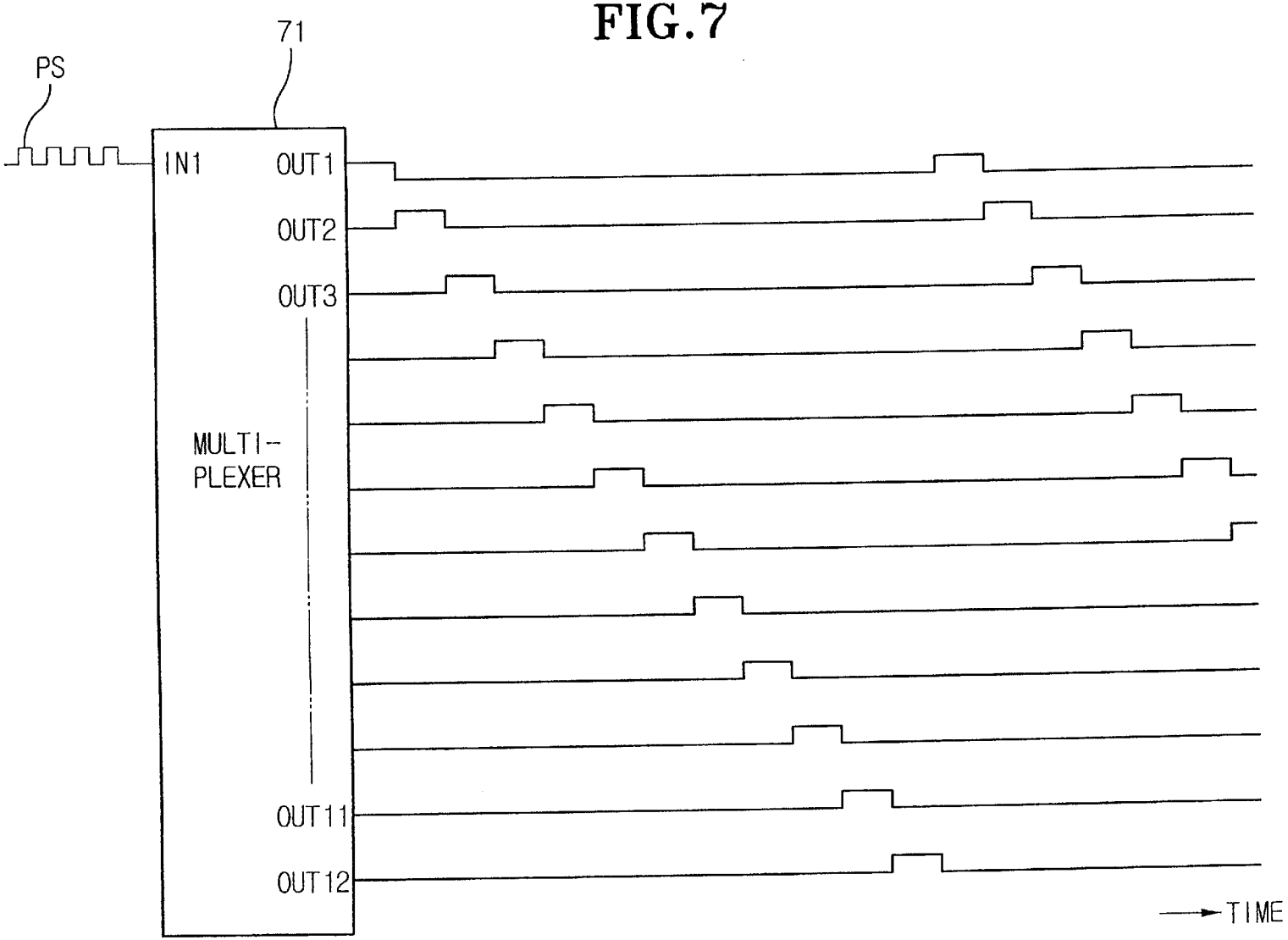
FIG. 7 is a wave form chart of output signals according to input signals to the multiplexer.

FIG. 7 is a wave form chart of output signals according to the input signals to the multiplexer. The pulse signals (PS) are inputted to an input terminal IN1 of a multiplexer 71 of FIGS. 6 and 7 in accordance with the information about conveyance direction and position of the head. Further, as shown in FIG. 7, the multiplexer 71 generates the pulse signals of FIG. 4 so as to input the pulse signals into the lines in twelve columns LR1, L2, LR3, . . . , and LR12, sequentially. Accordingly, by one external inputting line, the same results can be obtained by the conventional matrix drive method.

The recent technological development in semiconductors enables the maker to form the matrix drive method and multiplexer into one semiconductor head chip together with the nozzle.

As described above, according to the ink jet printer head from the preferred embodiment of the present invention, lines in a plurality of rows can be selected by inputting external signals through one external inputting line. Accordingly, even when the number of nozzles is increased, the number of pads does not increase as much.

While an ink jet printer head of the matrix drive method having the multiplexer according to the present invention has been particularly shown and described with reference to the preferred embodiment thereof, it will be understood by those skilled in the art that various changes in form and details may be affected therein without departing from the spirit and scope of the invention as defined by the appended claims.

What is claimed is:

1. An ink jet printer head, comprising:

a first unit having a first input terminal and a plurality of output terminals, an externally applied first signal transmitting into the first input terminal, the first signal being distributed to the plurality of output terminals, said first unit outputting a second signal from the applied first signal, the second signal being outputted through a first one of the plurality of output terminals sequentially by order of the first signal inputted through the first input terminal, the second signal being a distributed portion of the first signal;

a first signal line conducting the second signal from the first output terminal of said first unit;

a second input terminal having an externally applied third signal;

a second signal line conducting the third signal from said second input terminal;

an electronic switch accepting the second signal from said first unit through said first signal line and the third signal from said second input terminal through said second signal line;

an actuator electrically controlled by said electronic switch; and a nozzle ejecting ink through a control of said actuator, said nozzle ejecting ink when the third signal and the second signal are received by said electronic switch.

2. The ink jet printer head of claim 1, with the first signal being generated in accordance with a conveyance direction and position of said ink jet printer head.

3. The ink jet printer head of claim 1, with the second signal being generated in accordance with image data and each one of the plurality of output terminals having a separate signal line coupled to a distinct row of actuators.

4. The ink jet printer head of claim 1, with said first unit comprising a multiplexer, said multiplexer having a single input and a plurality of outputs.

5. The ink jet printer head of claim 1, with the actuator comprising a heating element, said heating element heating the ink within a chamber of said nozzle by voltage applied to said heating element, the ink ejecting through the nozzle as the ink is heated.

6. The ink jet printer head of claim 1, with said electronic switch being comprised of a field effect transistor, said field effect transistor having a source of a principal electrically conducting channel, a drain of said principal electrically conducting channel, and a gate, said gate regulating a current flow between said source and said drain of said principal electrically conducting channel.

7. The ink jet printer head of claim 6, with said field effect transistor having said gate coupled with said second signal line, said drain being coupled with said actuator and said source being coupled to a ground.

8. The ink jet printer head of claim 1, with said electronic switch being comprised of a transistor, said transistor having a first electrode of a principal electrically conducting channel, a second electrode of said principal electrically conducting channel, and a control electrode, said control electrode regulating a current flow between said first electrode and said second electrode of said principal electrically conducting channel.

9. The ink jet printer head of claim 1, being comprised of a single integrated semiconductor chip.

10. An ink jet printer head, comprising:

a multiplexer having a first input terminal and a plurality of output terminals, an externally applied first signal transmitting into the first input terminal, the first signal being distributed to the plurality of output terminals, said multiplexer outputting a second signal from the applied first signal, the second signal being outputted through a first one of the plurality of output terminals sequentially by order of the first signal inputted through the first input terminal, the second signal being a distributed portion of the first signal;

a first horizontal signal line conducting the second signal from the first output terminal of said multiplexer;

a second input terminal having an externally applied third signal;

a first vertical signal line conducting the third signal from said second input terminal;

a first electronic switch accepting the second signal from said multiplexer through said first horizontal signal line and the third signal from said second input terminal through said first vertical signal line;

a first actuator electrically controlled by said electronic switch; and a first nozzle ejecting ink through a control of said first actuator, said first nozzle ejecting ink when the third signal and the second signal are received by said first electronic switch.

11. The ink jet printer head of claim 10, with the first signal being generated in accordance with a conveyance direction and position of said ink jet printer head, and the second signal being generated in accordance with image data.

12. The ink jet printer head of claim 11, with said ink jet printer head being comprised of a single integrated semiconductor chip.

13. The ink jet printer head of claim 12, with the first actuator being comprised of a heating element, said heating element heating the ink within a chamber of said nozzle by voltage applied to said heating element, the ink ejecting through the first nozzle as the ink is heated.

14. The ink jet printer head of claim 13, with said first electronic switch being comprised of a field effect transistor, said field effect transistor having a source of a principal electrically conducting channel, a drain of said principal electrically conducting channel, and a gate, said gate regulating a current flow between said source and said drain of said principal electrically conducting channel.

15. The ink jet printer head of claim 14, with said field effect transistor having said gate coupled with said first vertical signal line, said drain being coupled with said first actuator and said source being coupled to a ground.

16. The ink jet printer head of claim 13, with said first electronic switch being comprised of a transistor, said transistor having a first electrode of a principal electrically conducting channel, a second electrode of said principal electrically conducting channel, and a control electrode, said control electrode regulating a current flow between said first electrode and said second electrode of said principal electrically conducting channel.

17. The ink jet printer head of claim 16, further comprising:

a second electronic switch accepting the second signal from said multiplexer through a first horizontal signal line and the third signal from a second vertical signal line;

a second actuator electrically controlled by said second electronic switch;

a second nozzle ejecting ink through a control of said second actuator;

a third electronic switch accepting the second signal from said multiplexer through a second horizontal signal line and the third signal from the first vertical signal line coupled with a second output terminal from said multiplexer;

a third actuator electrically controlled by said third electronic switch; and a third nozzle ejecting ink through a control of said third actuator.

18. A method, comprising the steps of:

inserting a multiplexer having a first input terminal and a plurality of output terminals into an ink jet printer head, an externally applied first signal transmitting into the first input terminal, the first signal being distributed to the plurality of output terminals, said multiplexer outputting a second signal from the applied first signal, the second signal being outputted through a first one of the plurality of output terminals sequentially by order of the first signal inputted through the first input terminal, the second signal being a distributed portion of the first signal;

attaching a first signal line conducting the second signal from the first output terminal of said multiplexer;

inserting into said ink jet printer head a second input terminal having an externally applied third signal;

attaching a second signal line to said second input terminal, said second signal line conducting the third signal from said second input terminal;

coupling an electronic switch with said first signal line and said second signal line, said electronic switch accepting the second signal from said multiplexer through said first signal line and the third signal from said second input terminal through said second signal line;

coupling an actuator with said electronic switch, said actuator electrically controlled by said electronic switch; and coupling a nozzle with said actuator, said nozzle ejecting ink through a control of said actuator, said nozzle ejecting ink when the third signal and the second signal are received by said electronic switch.

19. The method of claim 18, with the first signal being generated in accordance with a conveyance direction and position of said ink jet printer head, the second signal being generated in accordance with image data, and the actuator being comprised of a heating element, said heating element heating the ink within a chamber of said nozzle by voltage applied to said heating element, the ink ejecting through the nozzle as the ink is heated.

20. The method of claim 19, with said electronic switch being comprised of a field effect transistor, said field effect transistor having a source of a principal electrically conducting channel, a drain of said principal electrically conducting channel, and a gate, said gate regulating a current flow between said source and said drain of said principal electrically conducting channel, said field effect transistor having said gate coupled with said second signal line, said drain being coupled with said actuator, and said source being coupled to a ground.

* * * * *